US005511804A

United States Patent [19]

Pellegrini, Jr. et al.

[11] Patent Number: 5,511,804

[45] Date of Patent: Apr. 30, 1996

[54] BRAKING DEVICE, PARTICULARLY FOR SKATES

[75] Inventors: Alfred Pellegrini, Jr., Montebelluna; Andrea Tormena, Crocetta Del Montello, both of Italy

[73] Assignee: Nordica S.p.A., Trevignano, Italy

[21] Appl. No.: 388,235

[22] Filed: Feb. 13, 1995

Related U.S. Application Data

[63] Continuation-in-part of Ser. No. 51,421, Apr. 23, 1993, Pat. No. 5,388,844, which is a continuation of Ser. No. 136,055, Oct. 14, 1993, Pat. No. 5,397,137.

[30] Foreign Application Priority Data

| | | | |
|---|---|---|---|
| Apr. 29, 1992 | [IT] | Italy | TV92U0025 |
| Sep. 25, 1992 | [IT] | Italy | TV92U0046 |
| Oct. 21, 1992 | [IT] | Italy | TV92A0120 |

[51] Int. Cl.[6] ..... A63C 17/14

[52] U.S. Cl. ..... 280/11.2; 188/5

[58] Field of Search ..... 280/11.2, 11.21, 280/11.22, 11.23, 11.36; 188/5

[56] References Cited

U.S. PATENT DOCUMENTS

| | | | |
|---|---|---|---|
| 920,848 | 5/1909 | Eubank, Jr. | 280/11.2 X |
| 979,169 | 12/1910 | Kennedy | 280/11.36 X |
| 1,402,010 | 1/1922 | Ormiston | 280/11.2 X |
| 1,445,048 | 2/1923 | Spross | 280/11.2 |
| 1,497,224 | 6/1924 | Ormiston | 280/11.2 |
| 1,687,739 | 10/1928 | Slusher | 280/11.2 |
| 2,179,592 | 11/1939 | Goettie | 280/11.2 |
| 3,767,220 | 10/1973 | Peterson | 280/11.2 X |
| 5,088,748 | 2/1992 | Koselka et al. | 280/11.2 |

*Primary Examiner*—Margaret A. Focarino
*Assistant Examiner*—Michael Mar
*Attorney, Agent, or Firm*—Hale and Dorr

[57] ABSTRACT

A braking device, particularly usable for skates including a shoe composed of a quarter articulated to a shell in turn associated with a supporting frame for one or more wheels. The device comprises at least one rod-like element which is rotatably associated with the quarter and is slidingly associated with a guide formed on a wing which is associated with the frame. The rod-like element is kinematically connected to a braking element articulated to the frame. When the quarter is rotated backwards, the rod-like element causes the braking element to rotate so that it interacts with the ground.

9 Claims, 1 Drawing Sheet

BRAKING DEVICE, PARTICULARLY FOR SKATES

This is a continuation-in-part of U.S. application Ser. No. 08/051,421 filed Apr. 23, 1993 now U.S. Pat. No. 5,388,844 and a continuation of U.S. application Ser. No. 08/136,055 filed Oct. 14, 1993 now U.S. Pat. No. 5,397,137.

BACKGROUND OF THE INVENTION

The present invention relates to a braking device particularly usable for skates which comprise a shoe composed of a quarter which is articulated to a shell which is in turn associated with a supporting frame for one or more wheels.

With conventional roller skates, whether constituted by shoe associated with a support for two pairs of mutually parallel wheels or by a shoe associated with a supporting frame for one or more aligned wheels, the problem is felt of braking said wheels in order to adjust the speed of said skate.

It is known to use adapted blocks or pads, usually made of rubber, which are arranged at the tip or heel region of the shoe or boot; when the user tilts the shoe forwards or backwards, the free end of the pad or block interacts with the ground, and braking is thus achieved.

However, these solutions are not optimum, because they require the user to rotate the shoe or boot, and therefore the frame associated therewith, at the tip or heel, and this can be the cause of a loss of balance with a subsequent fall.

U.S. Pat. No. 4,275,895 is known as a partial solution to this drawback; it discloses a brake for skates with two pairs of mutually parallel wheels, which acts at the rear wheels.

Said brake is constituted by a flap which is associated with the item of footgear in a rearward position; a plate is associated with said flap in a rearward position and is pivoted at the supporting frame for the item of footgear.

The plate has, at its free end, a transverse element on which a pair of C-shaped elements is formed at the lateral ends; the C-shaped elements interact, following a backward rotation imparted to the flap, with the rear wheels which face them so as to interact with the rolling surface of the wheels.

However, even this solution has drawbacks: it is in fact structurally complicated and thus difficult to industrialize: it furthermore entails the presence of adapted springs for allowing the flap to return to the position in which the pair of C-shaped elements does not interact with the wheels, and this further increases structural complexity.

Furthermore, the structural configuration of the brake causes the pair of C-shaped elements to interact with the wheel even upon a minimal backward rotation imparted to the flap and therefore also in case of involuntary movements, and this creates unwanted braking actions.

Finally, the interaction of the C-shaped element at the rolling surface of the wheels wears the wheels rapidly causing inefficient rolling, thus necessarily requiring frequent replacement.

SUMMARY OF THE INVENTION

The aim of the present invention is to eliminate the drawbacks described above in known types by providing a braking device for skates which is structurally very simple and easy to industrialize.

Within the scope of the above aim, an important object is to provide a braking device which can be activated by the user in case of actual need and thus not accidentally.

Another object is to provide a braking device which can be deactivated rapidly and simply by the user.

Another important object is to provide a braking device which protects the rolling surface of the wheels against wear.

Another object is to obtain a structurally simple device.

Another object is to obtain a device which associates with the preceding characteristics that of being reliable and safe in use, has low manufacturing costs and can also be applied to known skates.

This aim, these objects and others which will become apparent hereinafter are achieved by a braking device, particularly for skates comprising a shoe composed of a quarter articulated to a shell associated with a supporting frame for one or more wheels, characterized in that it comprises at least one rod-like element which is rotatably associated with said quarter at a first end and is slidingly associated, at a second end, with a guide formed on a wing which is associated with either one of said frame and shell, said rod-like element being kinematically connected to a braking element which is articulated to said frame.

BRIEF DESCRIPTION OF THE DRAWINGS

Further characteristics and advantages of the present invention will become apparent from the following detailed description of a particular embodiment, illustrated only by way of non-limitative example in the accompanying drawings, wherein.

DESCRIPTION OF THE PREFERRED EMBODIMENTS

Figure 1:
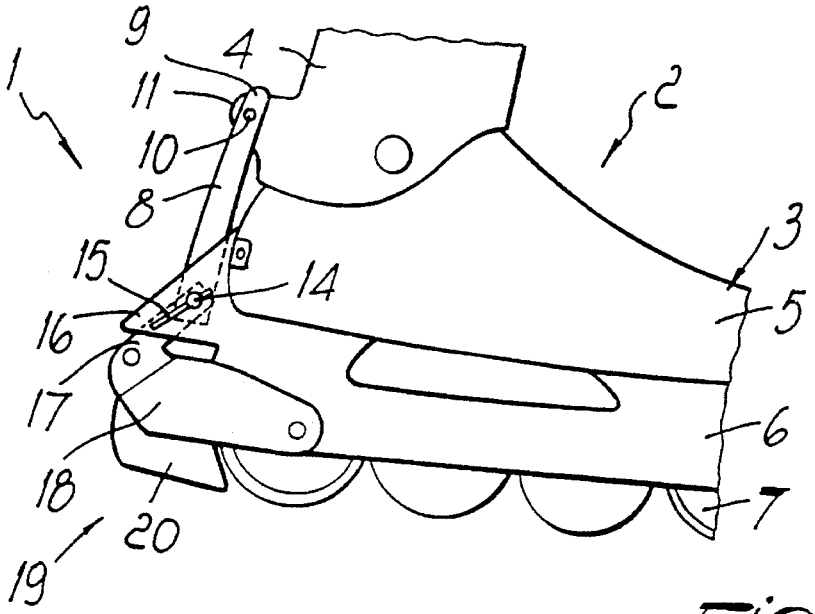
FIG. 1 is a side view of the braking device associated with the skate.
Figure 2:
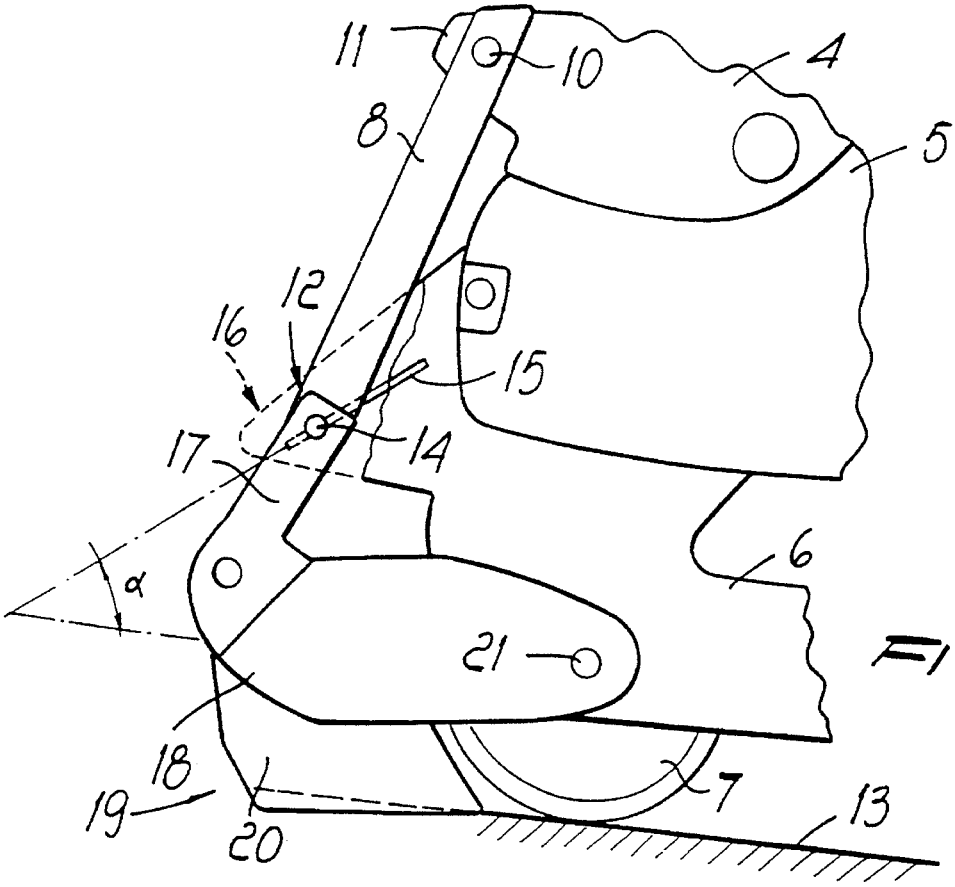
FIG. 2 is a partially sectional detail view of the braking device.

With reference to the above figures, the reference numeral 1 generally designates the braking device, which is particularly usable for a skate, designated by the reference numeral 2.

The skate 2 comprises a shoe, of boot 3 which is composed of a quarter 4, surrounding the rear lateral region of the user's leg, articulated to a shell 5. A frame 6 is associated with the shell in a lower region and supports one or more wheels, designated by the reference numeral 7, which may be mutually aligned, as in the illustrated embodiment.

Conventional fastening levers may be applied to the quarter 4 and shell 5.

The braking device comprises at least one rod-like element, generally designated by the reference numeral 8, which is arranged to the rear of the shoe 3 and is rotatably associated, at a first end 9, by means of a first pivot 10, to a protrusion 11 which protrudes to the rear of the quarter 4.

The rod-like element 8 is slidingly associated, by means of a second pivot 14, at the second end 12 which is directed toward the ground 13, with a guide 15 formed at a wing 16 which protrudes to the rear of the frame 6 or of the shell 5.

The guide 15 is inclined by an acute angle "α" with respect to the ground (assuming a counterclockwise rotation to be positive).

The free end of a bar 17 is pivoted to the second end 12 of the rod-like element 8, at the same second pivot 14. The bar 17 protrudes upwardly and is rigidly coupled to, or rotatably associated with, the end of a body 18 of a braking element 19 which is provided with a pad 20 suitable to interact with the ground.

At its other end, the body 18 is articulated to the frame 6 by means of a third pivot 21. The body 18 can swing about the pivot 21.

Use of the braking device is as follows: by virtue of the rotatable connection of the first end 9 of the rod-like element 8 to the protrusion 11 which protrudes from the quarter 4, if the user imparts a backward rotation to the quarter 4, the second end 12 of the rod-like element 8 moves with the guide 15 and, consequently, a rotation is imparted to the body 18 of the braking element 19, causing the pad 20 to interact with the ground.

This interaction occurs only for a preset rotation imparted to the quarter 4 which can be preset by the user, by virtue of the length which can be given to the rod-like element 8 or to the bar 17, or by varying the pivoting point of said bar, possibly providing a plurality of holes for adjustable connection to the second pivot 14 or by adjusting the position of the pad 20 with respect to the body 18 by means of an adjustment screw.

This is done to allow the interaction of the pad 20 with the ground 12 only when a given angle of backward rotation of the quarter 4 is exceeded, in order to avoid accidental braking actions, and also to compensate any wear of the pad 20.

Once the user returns to the skating position, the second end 12 of the rod-like element 8 and the bar 17 rise simultaneously, and thus the pad 20 separates immediately from the ground.

It has thus been observed that the invention has achieved the intended aim and objects, a braking device having been achieved which can be activated by the user at a presettable angle of backward rotation of the quarter; this can be achieved by giving the required length to the rod-like element 8 or to the bar 17, or by varying the kinematic system between them, or by varying the inclination of the guide 15, or by varying the position of the pad 20 with respect to the body 18.

Furthermore, the kinematic system which activates the braking element allows an extensive stroke of the body 18 and allows to obtain, during skating, a distance of the pad 20 from the ground which is sufficient to ensure that the pad does not accidentally interfere with the ground, particularly during curves.

Furthermore, both activation and deactivation of the braking element 19 are very simple, so as to allow to obtain a device which is structurally simple and easy to industrialize and can also be easily applied to known skates.

Naturally, the materials and the dimensions which constitute the individual components of the device of the present invention may be the most pertinent according to the specific requirements.

We claim:

1. A braking device in a skate assembly having a forward end, a rearward end, and an extension which extends from said forward end to said rearward end, the skate assembly comprising:

a shell for supporting a user's foot portion, a quarter arranged above said shell for supporting a user's ankle region and pivotally connected to said shell such that said quarter is pivotable substantially rearwardly into a rearward position and forwardly into a forward position about an axis which is substantially transverse with respect to said extension of the skate assembly, and a plurality of wheels mounted below said shell;

the braking device comprising:

a body element pivotally connected to a fixed portion of the skate assembly and having a portion extending rearwardly from a point at which the body element is connected to said fixed portion;

a braking element carried downwardly by said rearwardly extending portion of said body element for disengageable engagement into braking contact with a surface supporting said skate assembly;

an actuator comprising at least one rod-like element, said actuator being movably connected at a location intermediate its length to said skate assembly and having opposed end portions connected respectively to a rearward portion of said quarter and said rearwardly extending portion of said body element, whereby said body element pivots with respect to said fixed portion of the skate assembly when said quarter pivots with respect to said shell and said braking element is engaged into braking contact with the surface supporting said skate assembly when said quarter is pivoted in said rearward position and said braking element is disengaged from braking contact with the supporting surface when said quarter is pivoted in said forward position.

2. The braking device and skate assembly of claim 1, said actuator comprising a first upper rod-like element and a second lower rod-like element, an upper end of said first upper rod-like element being connected to said rearward portion of said quarter, a lower end of said second lower rod-like element being connected to said rearwardly extending portion of said body element, and a lower end of said first upper rod-like element being connected for pivotal movement relative to an upper end of said second lower rod-like element.

3. The braking device and skate assembly of claim 1 including:

a guide provided on said fixed portion of the skate assembly; and a pivot element slidably guided in said guide, said lower end of said first upper rod-like element and said upper end of said second lower rod-like element both being pivotally connected about said pivot element.

4. The braking device and skate assembly of claim 3, wherein said guide extends in a direction which forms an acute angle with the surface supporting the skate assembly.

5. The braking device and skate assembly of claim 3, wherein said guide is provided on a rearwardly extending wing element of said fixed portion of the skate assembly.

6. The braking device and skate assembly of claim 1, wherein at least one of said first and second rod-like elements is pivotally connected to the respective one of said fixed portion and said braking element.

7. In combination, a braking device and a skate assembly:

said skate assembly having a forward end and a rearward end and comprising:

a shell for supporting a user's foot portion and with said extension, a plurality of wheels rotatably supported below said shell, and a quarter arranged above said shell for supporting a user's ankle region and connected to said skate assembly for pivotal movement relative thereto about an axis which is substantially transverse with respect to said skate assembly such that the quarter is pivotable relative to said shell substantially rearwardly towards a rearward position and substantially forwardly towards a forward position; and the braking device comprising a body element pivotally connected to said said skate assembly, and having a portion extending rearwardly therefrom, a braking element carried downwardly by said rearwardly extending portion of said body element for disengageable engagement into braking contact with a surface supporting said skate assembly, a first upper rod-like element, and a second lower rod-like element, an upper end of said first upper rod-like element being connected to a rearwardly extending portion of said quarter for pivotal movement relative thereto, a lower end of said second lower rod-like element being connected to said rearwardly extending portion of said body element, and a lower end of said first upper rod-like element being connected relative to an upper end of said second lower rod-like element such that said upper rod-like element is pivotal relative to said second lower rod-like element, whereby said rod-like elements interconnect said rearward portion of said quarter and said rearwardly extending portion of said body element such that said body element pivots relative to said shell when said quarter pivots relative to said shell and said braking element is moved towards braking contact with the supporting surface when said quarter is pivoted towards said rearward position and said braking element is moved away from braking contact with the supporting surface when said quarter is pivoted towards said forward position.

8. The skate assembly of claim 7 wherein a first pivot extends substantially transverse to said frame and pivotally connects said upper end of said first upper rod-like element to said rearward portion of said quarter, and a second pivot extends substantially transverse to said frame and pivotally connects said lower end of said first upper rod-like element to said upper end of said second lower rod-like element.

9. The skate assembly of claim 8 wherein said lower end of the lower rod-like element is rotatably associated with the said rearwardly extending portion of said body element.

* * * * *